US009151494B2

(12) United States Patent
Quintaba' et al.

(10) Patent No.: US 9,151,494 B2
(45) Date of Patent: Oct. 6, 2015

(54) GAS BURNER WITH INWARD-FACING FLAME

(75) Inventors: Andrea Quintaba', Recanati (IT); Andrea Mandolesi, Recanati (IT); Paolo Serenellini, Castelfidardo (IT); Gianluca Giorgetti, Porto Recanati (IT)

(73) Assignee: SOMIPRESS SOCIETA METALLI INIETTATI S.P.A., Castelfidardo (IT)

( * ) Notice: Subject to any disclaimer, the term of this patent is extended or adjusted under 35 U.S.C. 154(b) by 291 days.

(21) Appl. No.: 13/700,337

(22) PCT Filed: Apr. 16, 2012

(86) PCT No.: PCT/EP2012/056883

§ 371 (c)(1), (2), (4) Date: Nov. 27, 2012

(87) PCT Pub. No.: WO2012/143319

PCT Pub. Date: Oct. 26, 2012

(65) Prior Publication Data

US 2013/0269676 A1 Oct. 17, 2013

(30) Foreign Application Priority Data

Apr. 19, 2011 (IT) ..... AN2011A0051

(51) Int. Cl.

| | |
|---|---|
| ***F23D 14/08*** | (2006.01) |
| ***F23D 14/06*** | (2006.01) |
| ***F23D 14/56*** | (2006.01) |

(Continued)

(52) U.S. Cl.

CPC ..... *F23D 14/08* (2013.01); *F23D 14/065* (2013.01); *F23D 14/085* (2013.01); *F23D 14/56* (2013.01); *F23D 14/58* (2013.01); *F24C 3/085* (2013.01); *F23D 2900/00003* (2013.01)

(58) Field of Classification Search

CPC ..... F23D 14/08; F24C 3/085
USPC ..... 431/347; 126/39 R, 39 E
See application file for complete search history.

(56) References Cited

U.S. PATENT DOCUMENTS

| | | | | |
|---|---|---|---|---|
| 2,805,710 | A * | 9/1957 | Brumbaugh | 239/544 |
| 2,817,397 | A * | 12/1957 | Brumbaugh | 239/544 |
| 3,042,110 | A * | 7/1962 | Weber et al. | 431/349 |

(Continued)

FOREIGN PATENT DOCUMENTS

| | | |
|---|---|---|
| FR | 818244 A | 9/1937 |
| WO | 9908046 A1 | 2/1999 |

(Continued)

OTHER PUBLICATIONS

International Search Report of corresponding application No. PCT/EP2012/056883 mailed Jul. 20, 2012.

*Primary Examiner* — Avinash Savani
(74) *Attorney, Agent, or Firm* — Lowe Hauptman & Ham, LLP

(57) ABSTRACT

A gas burner (300) with inward-facing flame is disclosed, comprising a base body (2) comprising a chamber (21) connected to a radial venturi pipe (7) fed by a gas injector (6); a mixing body (4) with toroidal base (42) that defines a toroidal mixing chamber (40) communicating with the chamber (21) of the base body; a circular upper cover (5) with internal surface (52) facing towards the axis of the upper cover, wherein a plurality of holes (53) is obtained, in communication with the mixing chamber (40) for inward-facing emission of flames.

18 Claims, 13 Drawing Sheets

(51) Int. Cl.
*F23D 14/58* (2006.01)
*F24C 3/08* (2006.01)

(56) References Cited

U.S. PATENT DOCUMENTS 3,627,462 A * 12/1971 Lotter ..... 431/284
2004/0234915 A1* 11/2004 Koch et al. ..... 431/278
2006/0196493 A1* 9/2006 Serenellini ..... 126/39 E
2009/0162801 A1* 6/2009 McCrorey et al. ..... 431/12
2010/0101557 A1* 4/2010 Gasparini ..... 126/39 E
2010/0126496 A1* 5/2010 Luo et al. ..... 126/39 E
2010/0154776 A1 6/2010 Czajka et al.

FOREIGN PATENT DOCUMENTS

WO 2006077086 A1 7/2006
WO 2008116773 A2 10/2008

* cited by examiner

GAS BURNER WITH INWARD-FACING FLAME

The present patent application for industrial invention relates to a gas burner with inward-facing flame.

Gas cooking assemblies with outward-facing flame are commonly known on the market. However, said gas cooking assemblies are impaired by low efficiency.

In order to improve efficiency, gas cooking assemblies with inward-facing flame are known. WO2006/077086 discloses a gas burner with two injectors, one main flame ring (43) facing outwards and one second flame ring (27, 40) facing inwards. Referring to FIGS. 3 and 4 of WO2006/077086, the secondary air (32) taken above the cooking hob generates a single flow that, through passageways (14) of the base of the burner, arrives in the internal part of the burner, feeding internal flames (27, 40). In fact, secondary air (32) cannot generate a second flow to feed the internal flames (27, 40) also passing above the cap (8) of the burner because the external flame ring (43) creates a thermal barrier and uses all the secondary air that arrives above the burner crown.

The purpose of the present invention is to eliminate the drawbacks of the prior art, by devising a gas burner with inward-facing flame that is efficient, safe and at the same time easy to make and install.

These purposes are achieved according to the invention, with the characteristics claimed in the enclosed independent claim 1.

Advantageous embodiments will appear from the dependent claims.

The gas burner with inward-facing flame according to the invention comprises:

- a base body disposed under a cooktop, said base body comprising a chamber connected to at least one horizontal venturi pipe fed by at least one gas injector;
- a mixing body disposed above said base body above the cooktop, said mixing body being provided with a toroidal base that defines a toroidal mixing chamber communicating with the chamber of the base body and at least one hole for secondary air passage;
- a circular upper cover disposed above said mixing body, said upper cover being provided with at least one hole communicating with said at least one hole of the mixing body for secondary air passage and internal surface facing towards the axis of the upper cover in which a plurality of flame holes is obtained in communication with the mixing chamber to emission of flames inwards.

The base of the mixing body is spaced from the base body and cooktop, in such manner to generate a gap through which a first secondary air flow can flow above the cooktop. Said first secondary flow passes through said at least one hole of the mixing body and said at least one hole of the upper cover, in such manner to feed with air the flame coming out from the holes of the upper cover.

The upper cover has external surface inclined by an angle comprised between 55° and 75° relative to a horizontal plane parallel to the cooktop and internal surface inclined by an angle comprised between 5° and 25° relative to said horizontal plane parallel to the cooktop, in such manner to generate a second secondary air flow above the cooktop grazing the external surface and the internal surface of the upper cover.

The advantages of the gas burner according to the invention are evident, being an easy-to-assembly simple structure that optimizes the secondary air flow above the cooktop, thus obtaining high flame efficiency and reducing the flame diameter.

Further characteristics of the invention will appear clearer from the detailed description below, which refers to merely illustrative, not limitative, embodiments, illustrated in the attached drawings, wherein.

Referring to the aforementioned figures, the gas burner of the invention is disclosed, generally indicated with numeral (100).

Figure 1:
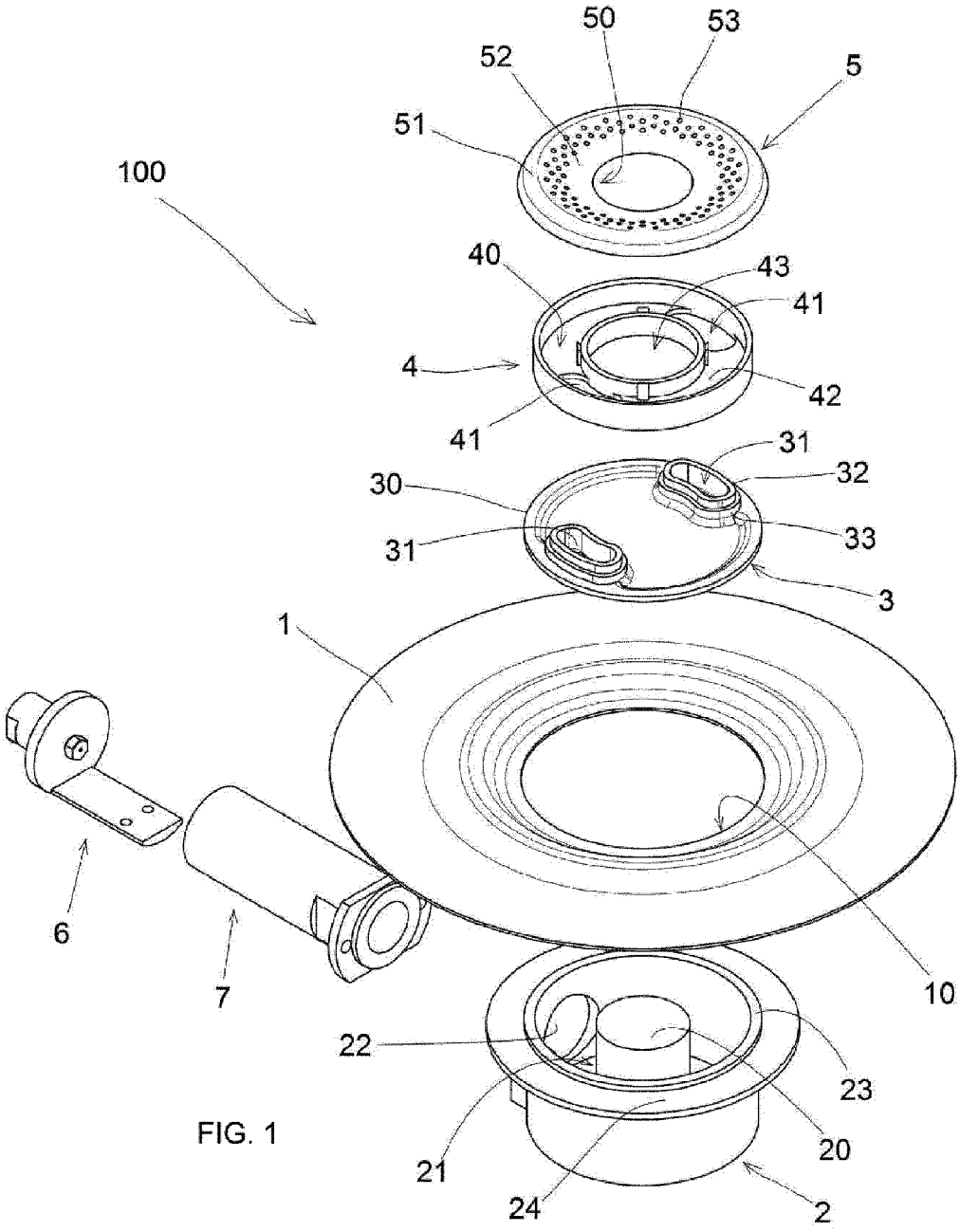
FIG. 1 is an exploded perspective view of the gas burner according to the invention.

Referring now to FIG. 1, a cooktop (1) is disclosed, being provided with a circular hole (10) the gas burner (100) is mounted.

The gas burner (100) comprises a base body (2), an intermediate cover (3), a mixing body (4) and an upper cover (5). A gas injector (6) is connected to the base body (2) by means of a venturi pipe (7).

The base body (2) has a cylindrical shape with a central element (20) in such manner to define a toroidal gas injection chamber (21) opened on top.

The lateral cylindrical wall of the base body (2) is provided with a radial hole (22) coupled with the venturi pipe (7). The venturi pipe (7) has a cylindrical shape with horizontal radial axis relative to the base body (2). Although only one injector and only one radial venturi pipe are shown in the figure, multiple injectors and multiple horizontal venturi pipes can be used, also in non-radial arrangement.

Figure 2:
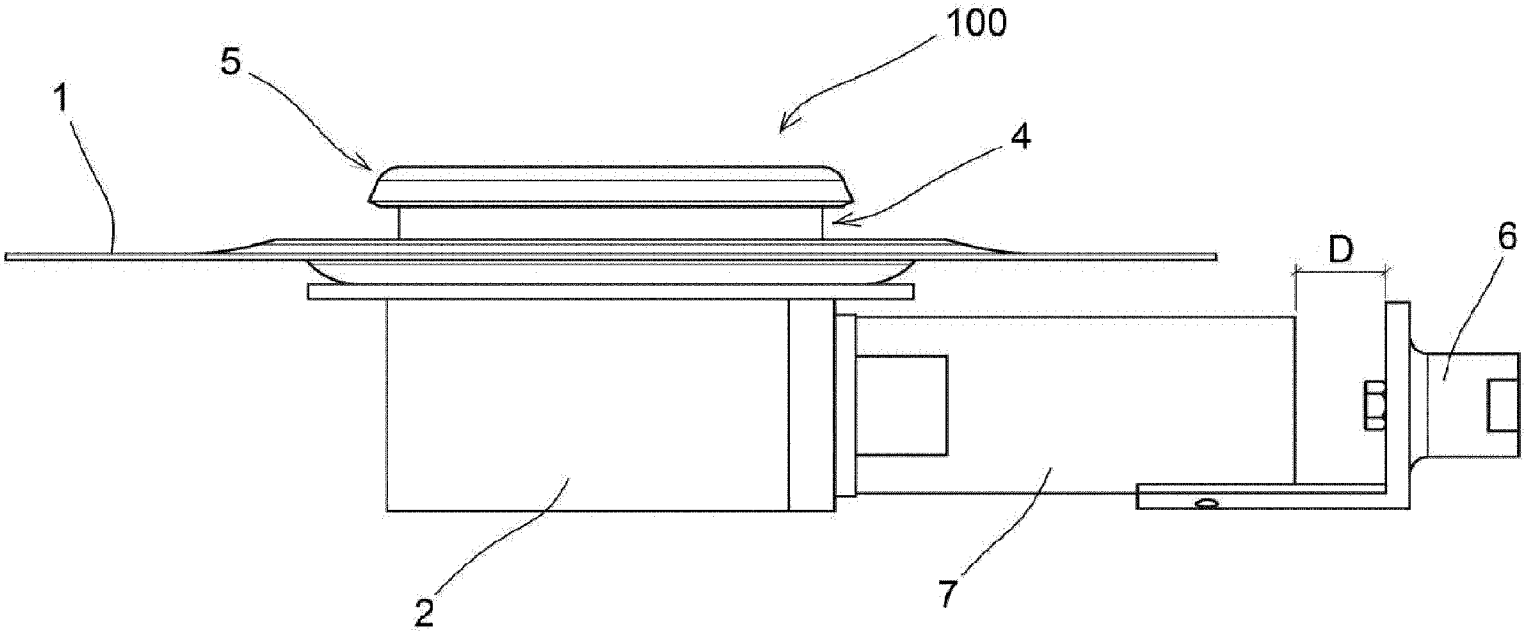
FIG. 2 is a side view of the gas burner of FIG. 1 in assembled condition.
Figure 3:
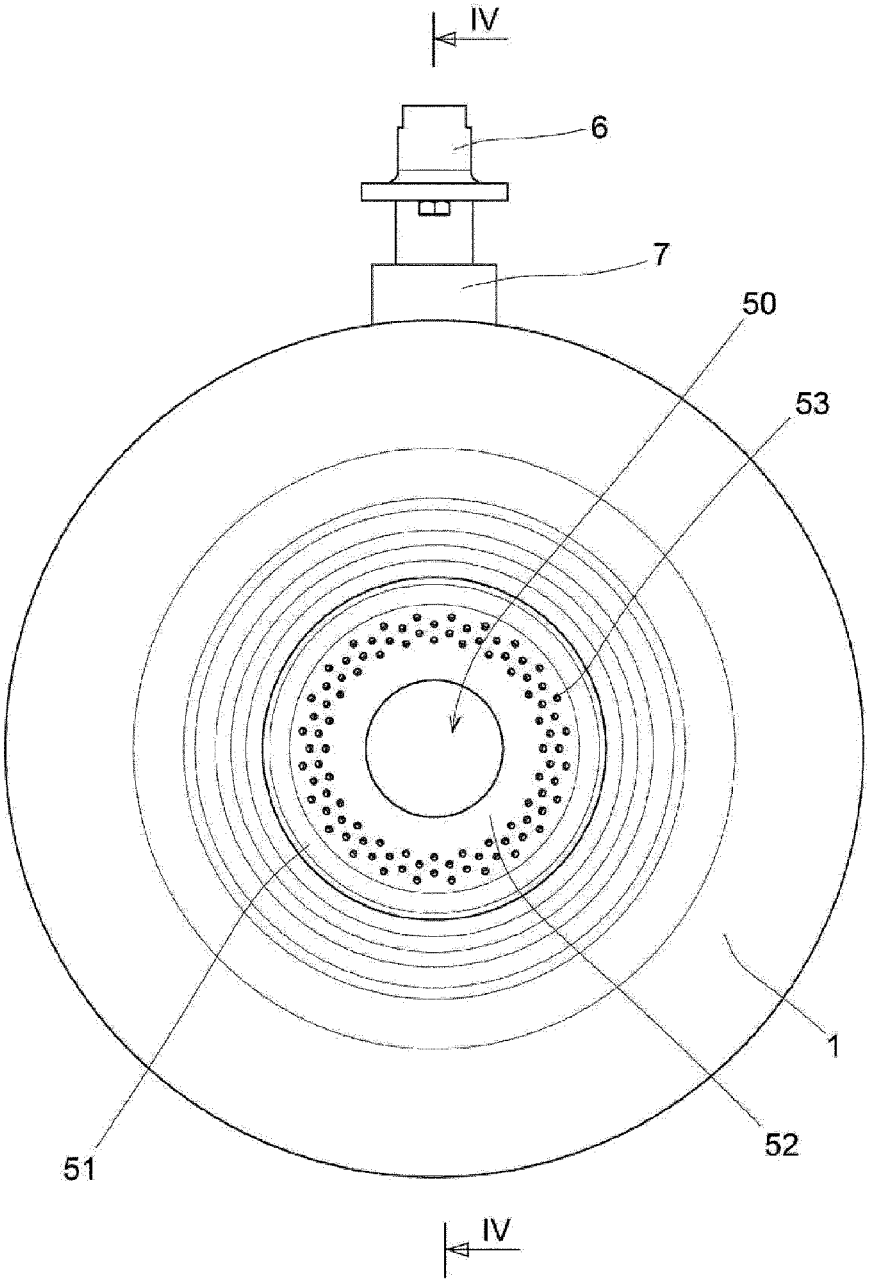
FIG. 3 is a top view of the gas burner of FIG. 1 in assembled condition.
Figure 4:
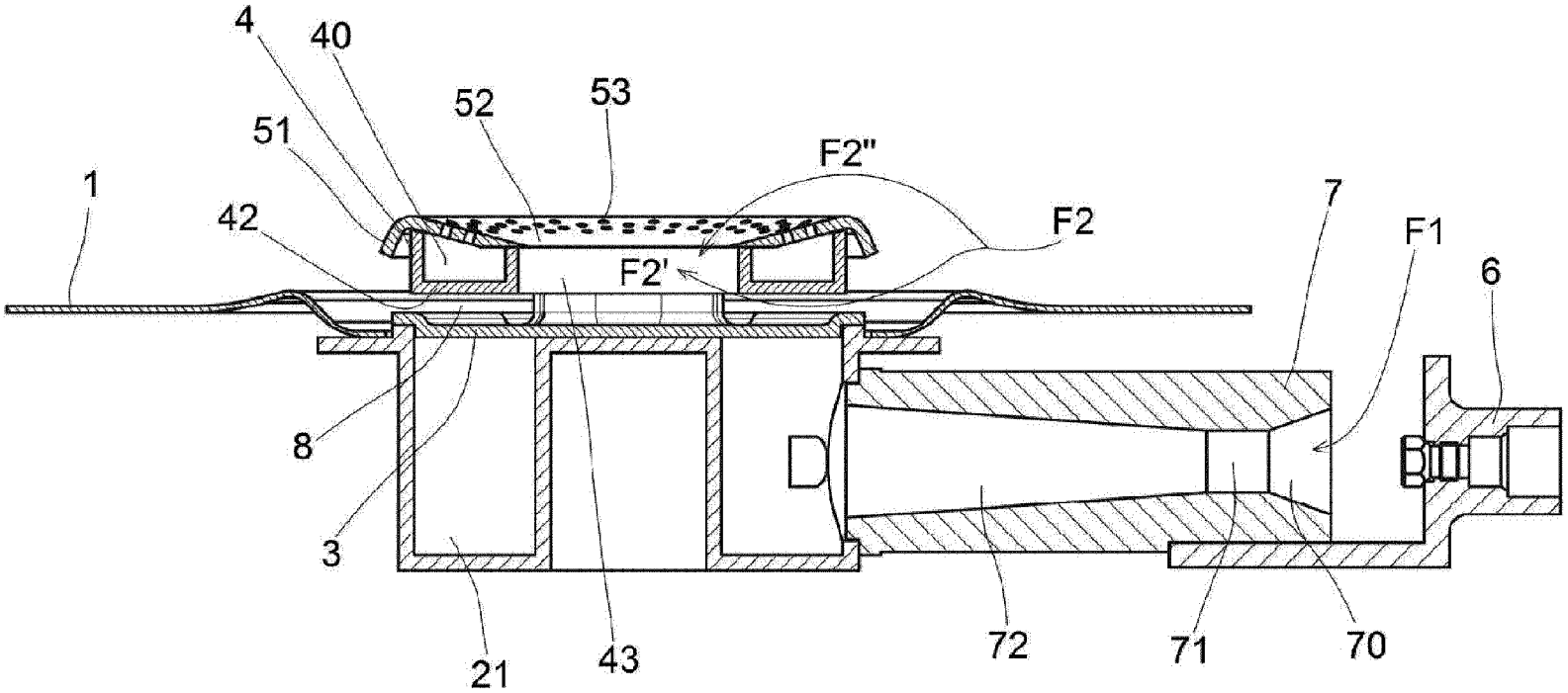
FIG. 4 is a cross-sectional view along plane IV-IV of FIG. 3.
Figure 5:
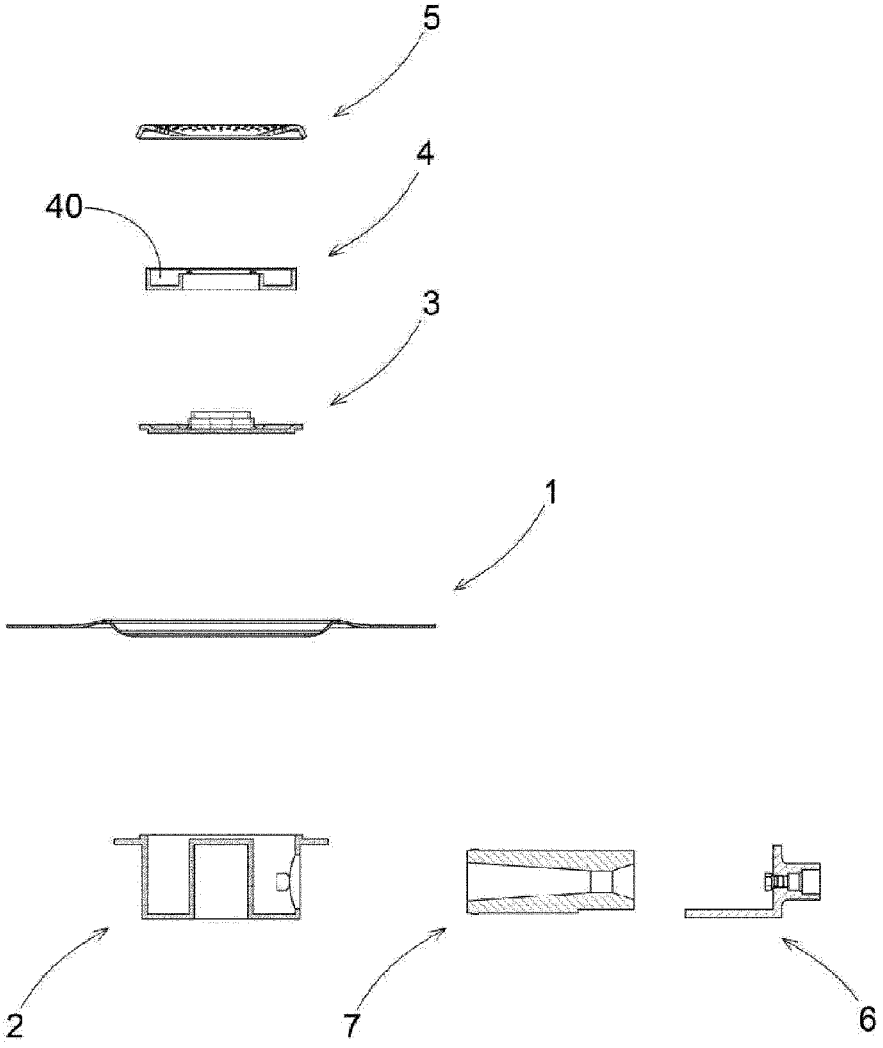
FIG. 5 is an exploded cross-sectional view of the gas burner of FIG. 4.

As shown in FIGS. 2 and 4, the injector (6) is disposed at a suitable distance (D) from the free end of the venturi pipe (7), in such manner to adjust a primary air flow (F1) entering, by venturi effect, into the venturi pipe (7) and mixing with the gas injected by the injector (6). The primary air flow (F1) enters below the cooktop (1).

The venturi pipe (7) has a tapered inlet section (70) with decreasing diameter, an intermediate cylindrical section (71) and a tapered outlet section (72) with increasing diameter.

Going back to FIG. 1, the base body (2) has an annular upper edge (23) and a disc-shaped flange (24). The upper edge (23) is inserted in the hole (10) of the cooktop and the upper flange (24) is stopped against the lower surface of the cooktop. So, the cylindrical part of the base body (2) is disposed under the cooktop (1).

The intermediate cover (3) is shaped as a circular plate and provided with an annular edge (30) that is stopped against the upper edge (23) of the base body. In view of the above, the intermediate cover (3) is basically at the same level as the cooktop (1) and acts as cover for the chamber (21) of the base body.

The intermediate cover (30) has two peripheral slots (32) for passage of air-gas mixture. The slots (32) are disposed in diametrically opposite radial position relative to the base body. Although two slots are shown in the figure, one slot only or more than two slots can be provided.

Shanks (32) are obtained around the slots (31), protruding in upper position from the intermediate cover.

On the intermediate cover (3) the mixing body (4) is mounted, having a cylindrical shape with central hole (43) and a base (42) defining a toroidal mixing chamber (40) opened on top, basically having the same dimensions as the chamber (21) of the base body.

Two slots (41) are obtained in the base (42) of the mixing body (4). Also the mixing body can be provided with only one or more than two slots.

The shanks (32) of the intermediate cover (3) engage inside the slots (41) of the mixing body, in such manner to put the chamber (21) of the base body in communication with the mixing chamber (40) wherein mixing of gas with primary air is completed.

Figure 6:
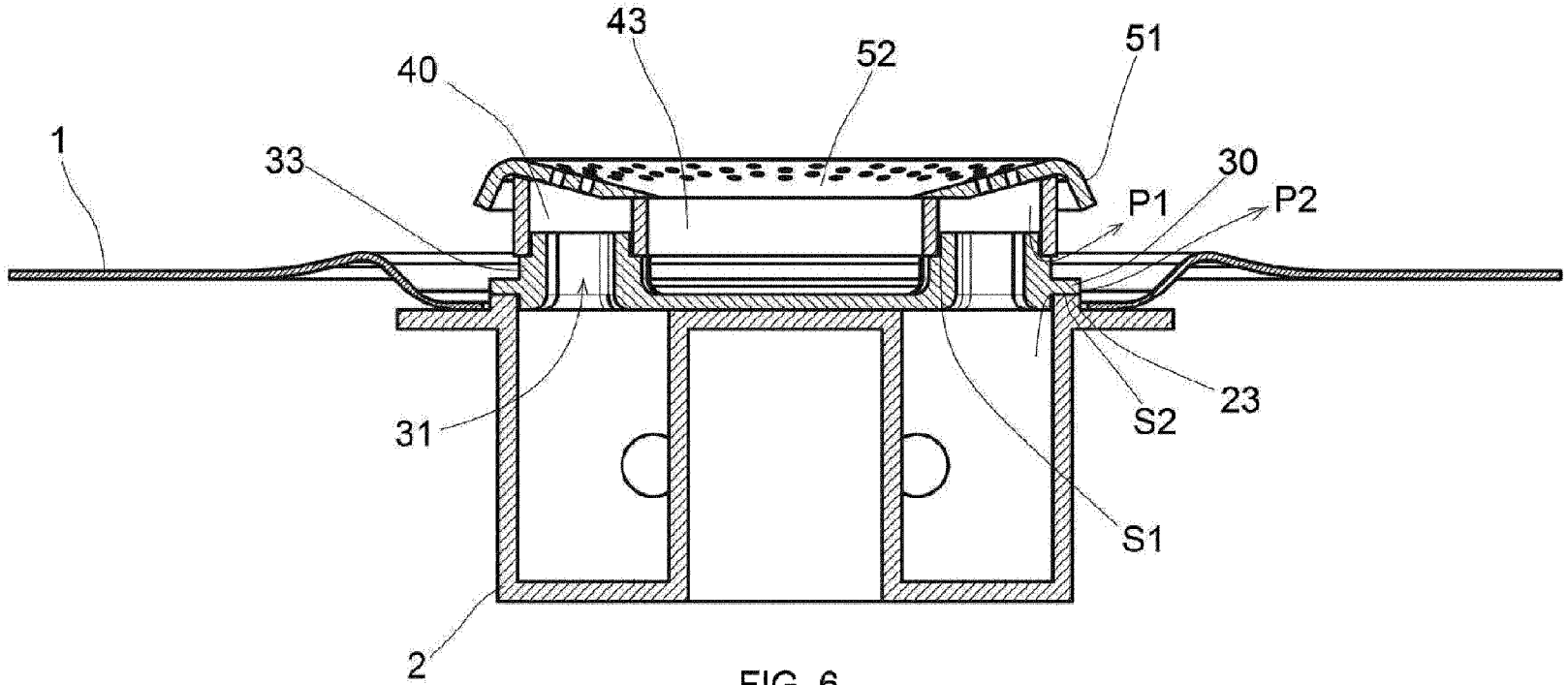
FIG. 6 is a cross-sectional view along plane VI-VI of FIG. 3.
Figure 7:
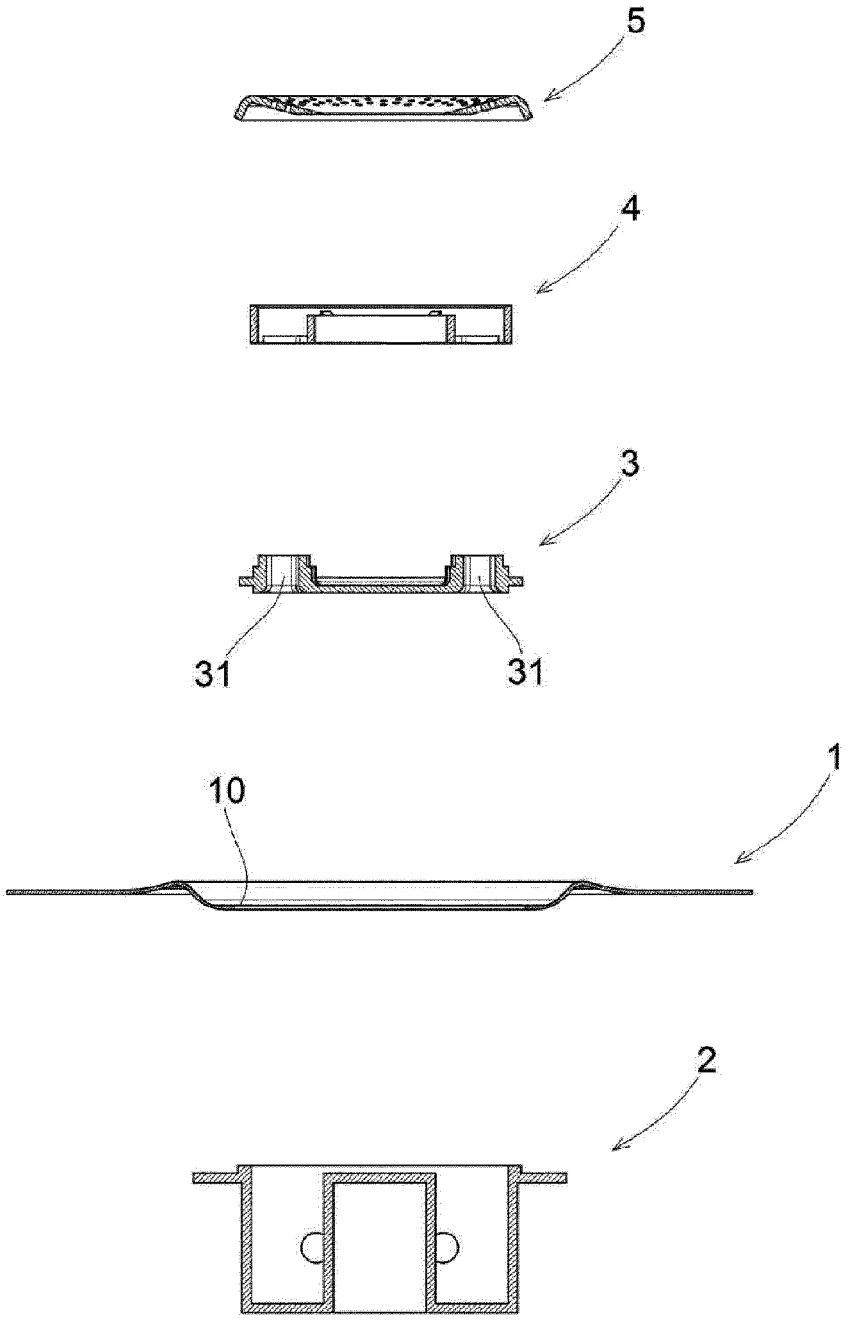
FIG. 7 is an exploded cross-sectional view of the gas burner of FIG. 6.

Referring to FIG. 6, the intermediate cover (3) and mixing body (4) have matching surfaces (S1) disposed above the cooktop (1), in such manner to convey any gas leaks (P1) from the mixing chamber above the cooktop (40). Likewise, the upper edge (23) of the base body and the lateral body (30) of the intermediate cover (3) have contact surfaces (S2) disposed above the cooktop (1), in such manner to convey any gas leaks (P2) from the gas injection chamber (20) above the cooktop.

The upper cover or crown (5) has a toroidal shape with central hole (50). The upper cover is provided with external outward-facing surface (51) and internal inward-facing surface (52), that is facing towards the axis of the central hole (50). As better shown in FIG. 10, the external surface (51) and internal surface (52) of the upper cover are given a suitable inclination relative to a horizontal plane (P) parallel to the cooktop (1) to optimize the secondary air flow, as described below.

The internal surface (52) is situated around the central hole (50) and has a plurality of small holes or through notches (53) for emission of flame towards the inside of the gas burner. In fact, the upper cover (5) closes the toroidal mixing chamber (40) and the holes (53) communicate with the mixing chamber (40).

Referring to FIG. 4, the mixing body (4) is mounted on the intermediate cover (3) in such manner to leave a gap (8) between the intermediate cover (3) and the base (42) of the mixing body. To that end, the shanks (32) of the intermediate cover are provided at the base with spacers (33) that are stopped against the base (42) of the mixing body, keeping the base (42) of the mixing body spaced from the intermediate cover (3).

So, a secondary air flow (F2) is taken only above the cooktop (1) and divided into two secondary air flows (F2') and (F2"). The first secondary air flow (F2') passes through the gap (8) between the intermediate cover (3) and the base of the mixing body (4) and is extracted upwards, in the central hole (43) of the mixing body and in the central hole (50) of the upper cover, feeding the flames coming out from the holes (53) of the upper cover.

Instead, the second secondary air flow (F2") grazes the external surface (51) of the upper cover and then moves downwards, grazing the internal surface (52) of the upper cover, feeding the flames coming out of the holes (53) of the upper cover.

Hereinafter elements that are identical or correspond to the ones described above are indicated with the same reference numbers, omitting their detailed description.

Figure 8:
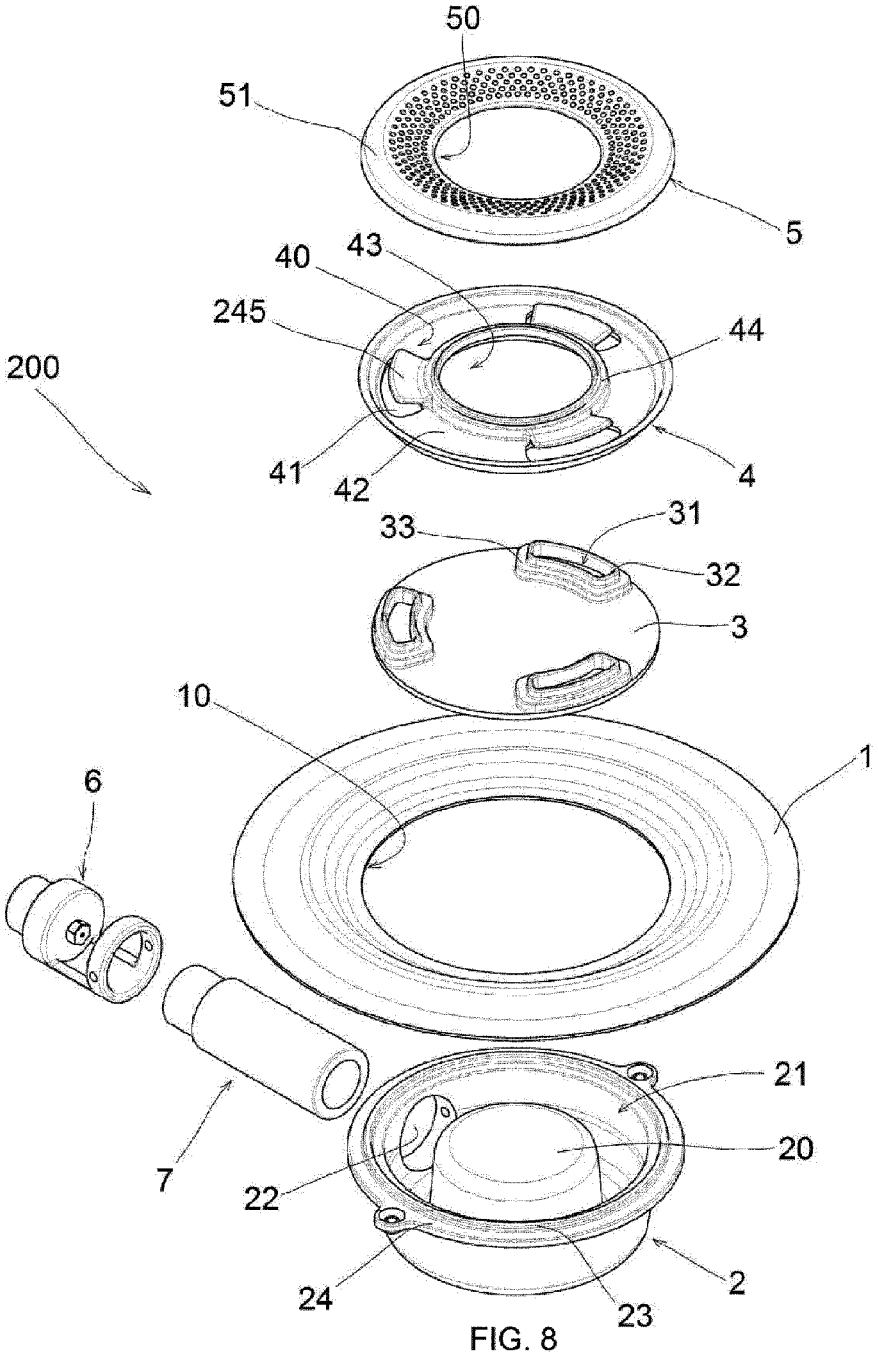
FIG. 8 is an exploded perspective view of a second embodiment of the gas burner according to the invention.
Figure 9:
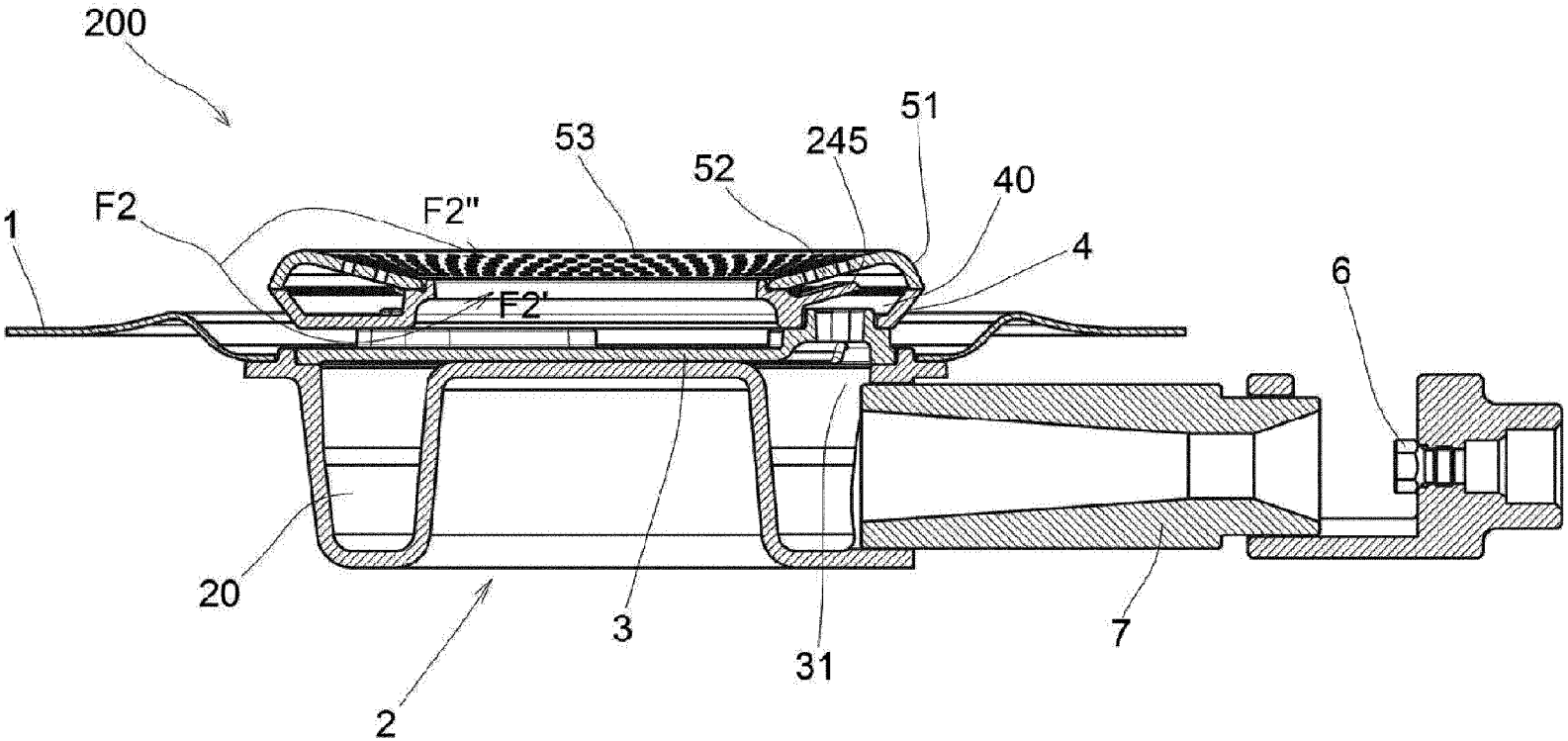
FIG. 9 is a cross-sectional view of the gas burner of FIG. 8 in assembled condition.

Referring to FIGS. 8 and 9 a second embodiment of a gas burner (200) according to the invention is described.

The gas burner (200) is basically the same as the gas cooking assembly (100). The gas burner (200) has an intermediate cover (3) composed of a planar disc-shaped plate, wherein three slots (31) spaced by 120° are obtained. Each slot (31) is surrounded by a shank (32) provided with spacer (33).

Likewise, the mixing body (4) has three slots (41) wherein the shanks (32) of the intermediate cover are engaged.

The mixing body (4) has an internal annular edge (44) around the central hole (43). Three partitions (245) are connected to the internal annular edge (44) and disposed above the corresponding slots (41) of the mixing body. The surface of the partitions (245) is basically the same as the surface of the slots (41). The partitions are slightly inclined upwards relative to the base (42) of the mixing body.

Said partitions (245) allow a radial flow of the air-gas mixture to enter the mixing chamber (40). So, the air-gas mixture is uniformly distributed in the mixing chamber (40), thus making the speed of the air-gas mixture through the holes (53) of the upper cover uniform.

Such a solution avoids a direct emission of the mixture from the mixing chamber (40) to the holes (53) of the upper cover.

Figure 10:
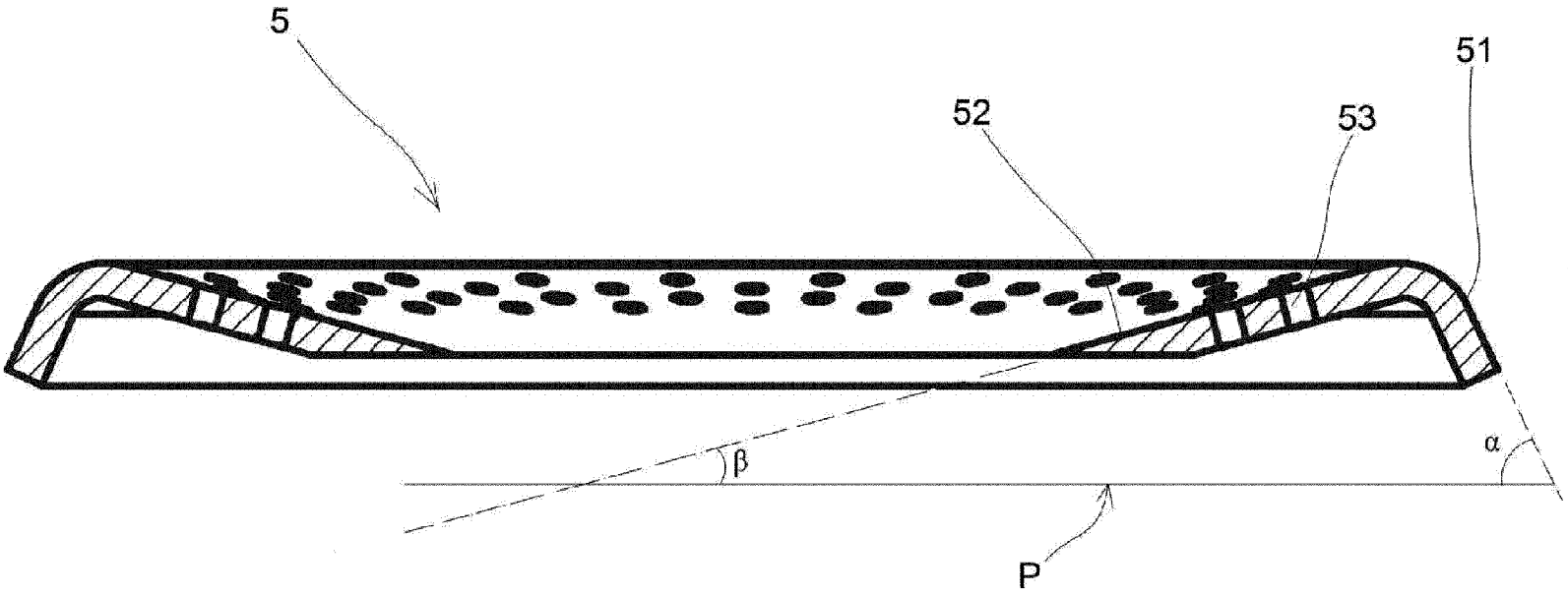
FIG. 10 is an enlarged axial view of a detail of the upper cover of the gas burner, showing the inclination angles of the external and internal surface of the cover.

Referring to FIG. 10, in the present invention the inclination of the external surface (51) and internal surface (52) of the upper cover has been studied relative to the horizontal plane (P) parallel to the cooktop (1) in order to optimize the secondary air flow (F2").

The external surface (51) is tilted by an angle ($\alpha$) comprised between 55° and 75°, preferably 65°, relative to the horizontal plane (P). Instead the internal surface (52) is tilted by an angle ($\beta$) comprised between 5° and 25°, preferably 15°, relative to the horizontal plane (P). In fact, inclination $\beta$=15° of the internal surface (52) allows for a better distribution of the secondary air (F2', F2") to the flames of the burner; whereas inclination $\alpha$=65° of the external surface (51) allows for creating a "turbulence" that favors the entrance of the secondary air flow (F2") above the upper cover (5).

Because of the shape of the upper body (5) the secondary air (F2) taken above the cooktop (1) is divided into two flows (F2' and F2"). The first secondary air flow (F2') passes through the gaps (8) under the mixing body (4), reaches the central part of the mixing body and feeds secondary air to the flame holes (53) in lower position of the upper cover; whereas the second secondary air flow (F2") passing above the upper cover (5) and following the profile of the external and internal surfaces (51, 52) of the upper cover, feeds the secondary air to the flame holes (53) in higher position of the upper cover.

This allows for creating multiple arrays of holes (53) on different height levels because there are two secondary air flows (F2', F2") feeding the flames of the burner simultaneously from below and from above. Advantageously, at least three arrays of holes (53) can be disposed at different heights. In the examples of the figures, four arrays of holes disposed at four height levels are provided, thus efficiently exploiting the internal surface (53) of the upper cover.

So, a burner with reduced flame ring is obtained compared to traditional burners available on the market (with same power) and therefore the burner of the invention is characterized by high efficiency and low gas consumption.

Figure 11:
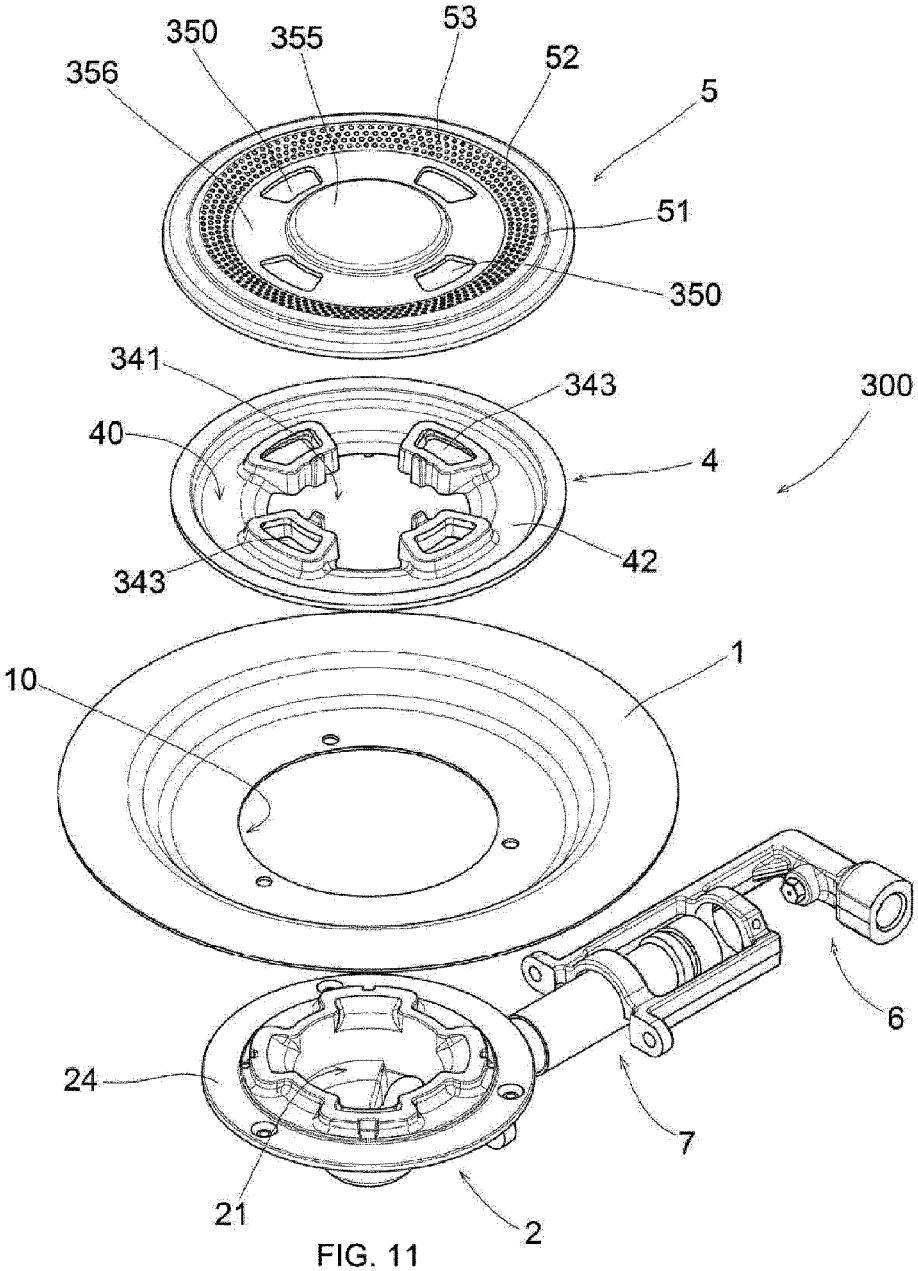
FIG. 11 is an exploded perspective view of a third embodiment of the gas burner according to the invention.
Figure 12:
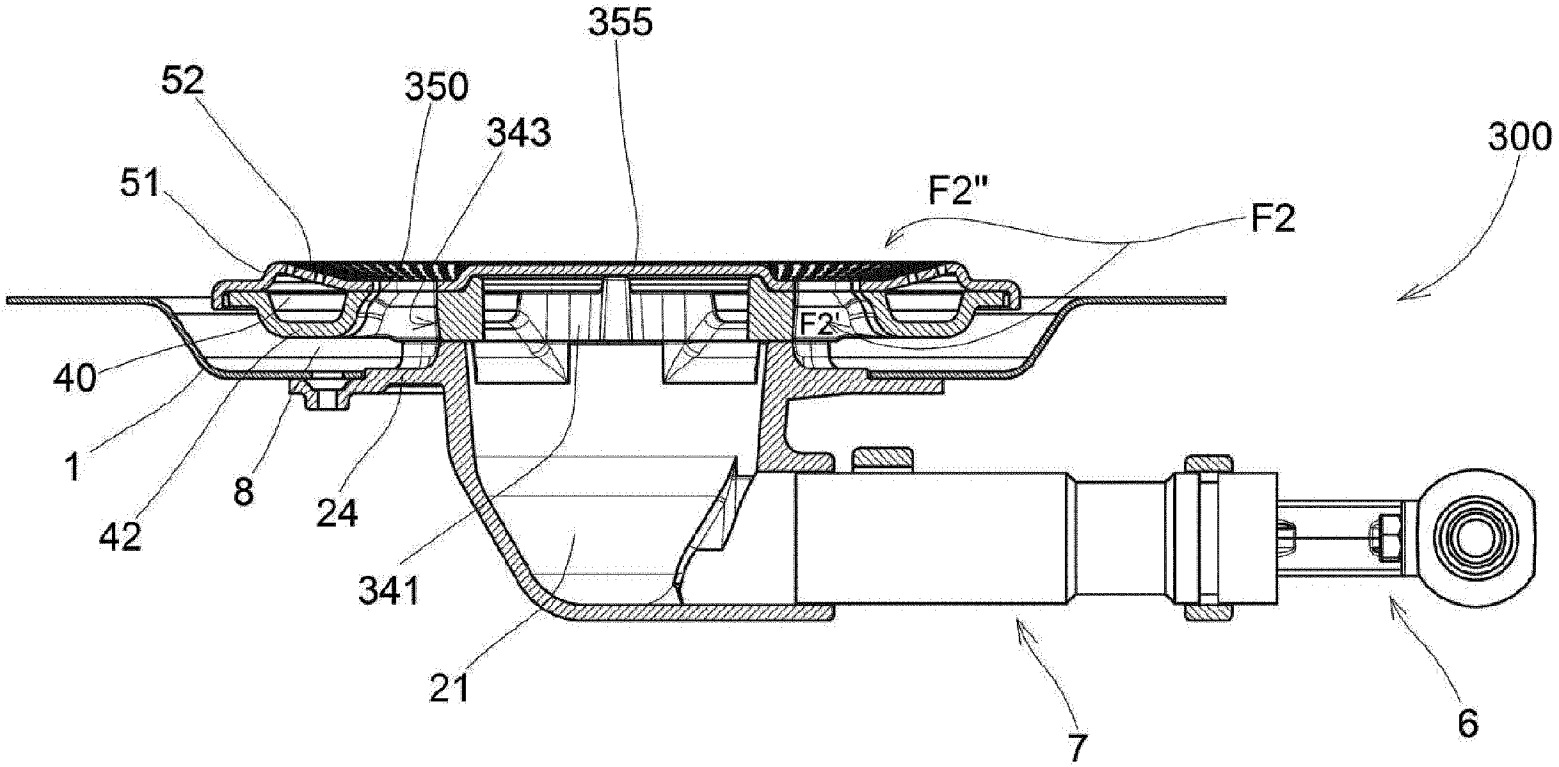
FIG. 12 is a cross-sectional view of the gas burner of FIG. 11 in assembled condition.
Figure 13:
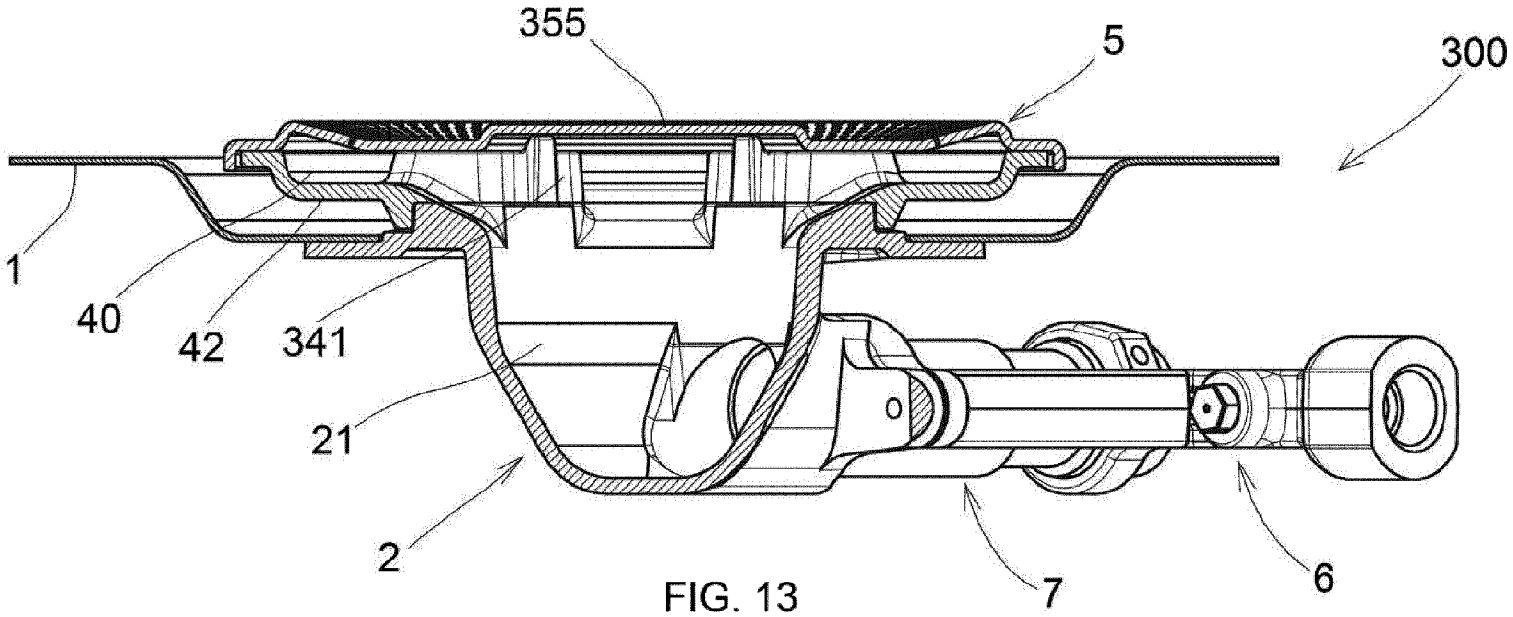
FIG. 13 is a cross-sectional view from another angle with respect to FIG. 12.

Referring to FIGS. 11 to 13, a third embodiment of a gas burner (300) according to the invention is described.

In this case, the chamber (21) of the base body is cylindrical, not toroidal.

The intermediate cover (3) has been eliminated.

The mixing body (4) comprises:

a base (42) defining a toroidal chamber (40), a central hole (341) communicating with the chamber (21) of the base body and the toroidal chamber (40), at least one peripheral hole (343) isolated from the toroidal chamber (40) and communicating with outside for secondary air passage.

Preferably, four peripheral holes (343) are provided in diametrically mutually spaced opposite directions.

The upper cover (5) is shaped as a disc and is provided with a central dish (355) and a peripheral toroidal area (356) disposed around the central dish (355). The central dish (355) and the peripheral area (356) are disposed according to a plane parallel to the horizontal plane (P) of the gas burner.

In the toroidal peripheral area (356) peripheral holes (350) are obtained, disposed in register with the peripheral holes (343) of the mixing body for secondary air emission.

Around the peripheral surface (356) the internal surface (52) is provided and tilted by an angle (β) relative to the horizontal plane (P). Around the internal surface (52) the external surface (51) is provided and tilted by an angle (α) relative to the horizontal plane (P).

As shown in FIG. 12, also in the gas burner (300) the secondary air flow (F2) above the cooktop is divided into a first flow (F2') passing through the gap (8) between cooktop (1)—base body (2) and base (42) of the mixing body and crossing the peripheral holes (343, 350), respectively of the mixing body (4) and upper cover (5).

The invention claimed is:

1. A gas cooking assembly (100; 200) comprising a gas burner and a cooktop (1), the gas burner comprising:

a base body (2) disposed under the cooktop (1), said base body (2) comprising a chamber (21) connected to at least one horizontal venturi pipe (7) fed by at least one gas injector (6);

an intermediate cover (3) disposed above said base body, substantially at the same level as the cooktop (1), said intermediate cover (3) being a disc-shaped plate and comprising at least one slot (31) in communication with said chamber (21) of the base body;

a mixing body (4) disposed above said base body (2) and above the cooktop (1), said mixing body (4) comprising:

a base (42) with toroidal shape that defines a toroidal mixing chamber (40) communicating with the chamber (21) of the base body; and at least one hole (43) for secondary air passage; and a circular upper cover (5) disposed above said mixing body (4), said upper cover (5) comprising:

at least one hole (50) communicating with said at least one hole (43) of the mixing body for secondary air passage; and an internal surface (52) facing towards the axis of the upper cover in which a plurality of flame holes (53) is configured in communication with the mixing chamber (40) so as to release flames inwards;

wherein the base (42) of the mixing body (4) is spaced apart from the base body (2) and cooktop (1) by a gap (8), the cooking assembly thereby being configured to allow a first secondary air flow (F2') to flow above the cooktop (1) and through said at least one hole (43) of the mixing body and said at least one hole (50) of the upper cover to feed with air the flames outgoing from the flame holes (53) of the upper cover, wherein said upper cover (5) has an external surface (51) inclined by an angle (α) between 55° and 75° with respect to a plane (P) parallel to the cooktop (1) and an internal surface (52) inclined by an angle (β) between 5° and 25° with respect to said plane (P) parallel to the cooktop (1), thereby being configured to generate a second secondary air flow (F2") above the cooktop (1) grazing the external surface (51) and the internal surface (52) of the upper cover.

2. A gas cooking assembly (100; 200) as claimed in claim 1, wherein said angle (α) between the external surface (51) of the upper cover and said plane (P) parallel to the cooktop is equal to 65°.

3. A gas cooking assembly (100; 200) as claimed in claim 1, wherein said angle (β) between the internal surface (52) of the upper cover and said plane (P) parallel to the cooktop is equal to 15°.

4. A gas cooking assembly (100; 200) as claimed in claim 1, wherein said holes (53) of the upper cover are arranged at least on three circular arrays at different levels of height.

5. A gas cooking assembly (100; 200) as claimed in claim 1, wherein said intermediate cover (3) comprises at least a shank (32) disposed around said slot (31) and protruding upwards, said shank being provided with a base spacer (33) adapted to keep said mixing body (4) spaced from said intermediate cover (3).

6. A gas cooking assembly (100; 200) as claimed in claim 1, wherein said intermediate cover (3) and said mixing body (4) have contact and coupling surfaces (S1) disposed above the cooktop (1), in such a way to convey any gas leaks (P1) from the mixing chamber (40) above the cooktop (1).

7. A gas cooking assembly (100; 200) as claimed in claim 1, wherein said base body (2) and intermediate cover (3) have contact surfaces (S2) disposed above the cooktop (1), in such a way to convey any gas leaks (P2) from the gas injection chamber (20) of the base body.

8. A gas cooking assembly (200) as claimed in claim 1, wherein said mixing body (4) further comprises partitions (245) disposed above mixing body slots (41) in such a way to allow a radial air-gas mixture to flow inside said mixing chamber (40).

9. A gas cooking assembly (100; 200) as claimed in claim 1, wherein said at least one gas injector (6) is spaced from an inlet (70) of said venturi pipe, in such a way to define a primary air inlet (F1) inside said venturi pipe, disposed under said cooktop (1).

10. A gas burner (100,200) comprising:

a base body (2), said base body (2) comprising a chamber (21) connected to at least one horizontal venturi pipe (7) fed by at least one gas injector (6);

an intermediate cover (3) disposed above said base body, said intermediate cover (3) being a disc-shaped plate and comprising at least one slot (31) in communication with said chamber (21) of the base body;

a mixing body (4) disposed above said base body (2), said mixing body (4) comprising:

a base (42) with toroidal shape that defines a toroidal mixing chamber (40) communicating with the chamber (21) of the base body; and at least one hole (43) for secondary air passage; and a circular upper cover (5) disposed above said mixing body (4), said upper cover (5) comprising:

at least one hole (50) communicating with said at least one hole (43) of the mixing body for secondary air passage; and an internal surface (52) facing towards the axis of the upper cover in which a plurality of flame holes (53) is configured in communication with the mixing chamber (40) so as to release flames inwards;

wherein the base (42) of the mixing body (4) is spaced apart from the base body (2) by a gap (8), the gas burner thereby being configured to allow a first secondary air flow (F2') to flow above the base body (2) and through said at least one hole (43) of the mixing body and said at least one hole (50) of the upper cover to feed with air the flames outgoing from the flame holes (53) of the upper cover, wherein said upper cover (5) has an external surface (51) inclined by an angle (α) between 55° and 75° with respect to a horizontal-plane (P) and an internal surface (52) inclined by an angle (β) between 5° and 25° with respect to said horizontal plane (P), thereby being configured to generate a second secondary air flow (F2") above the base body (2) grazing the external surface (51) and the internal surface (52) of the upper cover.

11. A gas burner (100; 200) as claimed in claim 10, wherein said angle (α) between the external surface (51) of the upper cover and said horizontal plane (P) is equal to 65°.

12. A gas burner (100; 200) as claimed in claim 10, wherein said angle (β) between the internal surface (52) of the upper cover and said horizontal-plane (P) is equal to 15°.

13. A gas burner (100; 200) as claimed in claim 10, wherein said holes (53) of the upper cover are arranged at least on three circular arrays at different levels of height.

14. A gas burner (100; 200) as claimed in claim 10, wherein said intermediate cover (3) comprises at least a shank (32) disposed around said slot (31) and protruding upwards, said shank being provided with a base spacer (33) adapted to keep said mixing body (4) spaced from said intermediate cover (3).

15. A gas burner (100; 200) as claimed in claim 10, wherein said intermediate cover (3) and said mixing body (4) have contact and coupling surfaces (S1) disposed above the base body (2), in such a way to convey any gas leaks (P1) from the mixing chamber (40) above the base body (2).

16. A gas burner (100; 200) as claimed in claim 10, wherein said base body (2) and intermediate cover (3) have contact surfaces (S2) disposed above the base body (2), in such a way to convey any gas leaks (P2) from the gas injection chamber (20) of the base body (2).

17. A gas burner (200) as claimed in claim 10, wherein said mixing body (4) further comprises partitions (245) disposed above mixing body slots (41) in such a way to allow a radial air-gas mixture to flow inside said mixing chamber (40).

18. A gas burner (100; 200) as claimed in claim 10, wherein said at least one gas injector (6) is spaced from an inlet (70) of said venturi pipe (7) in such a way to define a primary air inlet (F1) inside said venturi pipe (7).

* * * * *